US012612680B2

(12) United States Patent
Werner

(10) Patent No.: US 12,612,680 B2
(45) Date of Patent: Apr. 28, 2026

(54) EXTRACTION OF COPPER, GOLD AND OTHER ELEMENTS FROM WASTE MATERIALS

(71) Applicant: University of Kentucky Research Foundation, Lexington, KY (US)

(72) Inventor: Joshua M Werner, Lexington, KY (US)

(73) Assignee: University of Kentucky Research Foundation, Lexington, KY (US)

( * ) Notice: Subject to any disclaimer, the term of this patent is extended or adjusted under 35 U.S.C. 154(b) by 709 days.

(21) Appl. No.: 17/797,692

(22) PCT Filed: Feb. 8, 2021

(86) PCT No.: PCT/US2021/017109

§ 371 (c)(1),
(2) Date: Aug. 4, 2022

(87) PCT Pub. No.: WO2021/159089

PCT Pub. Date: Aug. 12, 2021

(65) Prior Publication Data

US 2023/0080921 A1 Mar. 16, 2023

Related U.S. Application Data

(60) Provisional application No. 62/972,379, filed on Feb. 10, 2020, provisional application No. 62/971,472, filed on Feb. 7, 2020.

(51) Int. Cl.

| | |
|---|---|
| ***C22B 11/00*** | (2006.01) |
| ***C22B 7/00*** | (2006.01) |
| ***C25C 1/12*** | (2006.01) |

(52) U.S. Cl.
CPC ..... *C22B 11/042* (2013.01); *C22B 7/008* (2013.01); *C25C 1/12* (2013.01)

(58) Field of Classification Search
CPC ..... C22B 11/042; C22B 7/008; C22B 3/26; C22B 3/44; C22B 7/005; C25C 1/12; Y02P 10/20
See application file for complete search history.

(56) References Cited

U.S. PATENT DOCUMENTS 5,234,669 A 8/1993 Bartlett
5,354,359 A 10/1994 Wan et al.
(Continued)

FOREIGN PATENT DOCUMENTS

AU 2014276702 A1 1/2016
CA 2505740 A1 6/2004

OTHER PUBLICATIONS

Alam, et al., Electrolyte purification in energy-saving monovalent copper electrowinning processes, Hydrometallurgy 87 (2007) 36-44.
(Continued)

*Primary Examiner* — Adil A. Siddiqui
(74) *Attorney, Agent, or Firm* — Stites & Harbison PLLC; Warren D. Schickli

(57) ABSTRACT

A method for recovering metals from waste materials includes steps of contacting a waste material feed stream with a first lixiviant adapted to leach copper and other base metals from the waste material feed stream and provide a treated waste material feed stream, recovering copper metal from the first lixiviant, contacting the treated waste material stream with a second lixiviant adapted to leach noble metals from the treated waste material feed stream and recovering gold from the second lixiviant.

11 Claims, 5 Drawing Sheets

(56) References Cited

U.S. PATENT DOCUMENTS

| | | | | |
|---|---|---|---|---|
| 7,309,408 | B2 | 12/2007 | Benavides | |
| 2002/0100681 | A1 | 8/2002 | Kirk et al. | |
| 2010/0132509 | A1 | 6/2010 | Ji et al. | |
| 2013/0091990 | A1 | 4/2013 | Choi et al. | |
| 2014/0212346 | A1 | 7/2014 | Xia | |
| 2016/0194734 | A1* | 7/2016 | Eksteen | C22B 3/165 75/744 |

OTHER PUBLICATIONS

Armina, et al., Gold Cementation from Ammonium Thiosulfate Solution by Zinc, Copper and Aluminium Powerders, Materials Transactions, vol. 43, No. 3, 2002, pp. 485-493.
Aylmore, et al., Thermodynamic analysis of gold leaching by ammoniacal thiosulfate using Eh/pH and speciation diagrams, Minerals & Metallurgical Processing, vol. 18. No. 4 • Nov. 2001, pp. 221-227.
Aylmore, et al., Thiosulfate Leaching of Gold—A Review, Minerals Engineering, vol. 14, No. 2, pp. 135-174, 2001.
Behnamfard, et al., Process development for recovery of copper and precious metals from waste printed circuit boards with emphasize on palladium and gold leaching and precipitation, Waste Management, 33, 2013, pp. 2354-2363.
Birloaga, et al., Study of multi-step hydrometallurgical methods to extract the valuable content of gold, silver and copper from waste printed circuit boards, Journal of Environmental Chemical Engineering 4 (2016) 20-29.
Breuer, et al., An electrochemical study of gold leaching in thiosulfate solutions containing copper and ammonia, Hydrometallurgy 65 (2002) 145-157.
Breuer, et al., The reduction of copper(II) and the oxidation of thiosulfate and oxysulfur anions in gold leaching solutions, Hydrometallurgy 70 (2003) 163-173.
Deng, et al., Gold recovery enhancement from a refractory flotation concentrate by sequential bioleaching and thiourea leach, Hydrometallurgy 63 (2002) 249-255.
Diaz, et al., Comprehensive Process for the Recovery of Value and Critical Materials from Electronic Waste, Idaho National Laboratory, Jul. 2016, pp. 1-38.
Eksteen, et al., The leaching and adsorption of gold using low concentration amino acids and hydrogen peroxide: Effect of catalytic ions, sulphide minerals and amino acid type, Minerals Engineering 70 (2015) 36-42.
Feng, et al., The role of oxygen in thiosulphate leaching of gold, Hydrometallurgy 85 (2007) 193-202.
Ficeriova, et al., Leaching of gold, silver and accompanying metals from circuit boards (PCBs) waste, Acta Montanistica Slovaca • Dec. 2011, pp. 128-131.
Garrido, et al., Copper Recovery From Ammonia Solutions Through Electro-Electrodialysis (EED), Frontiers in Chemistry, Jan. 2021, vol., pp. 1-8.
Grosse, et al., Leaching and recovery of gold using ammoniacal thiosulfate leach liquors (a review), Hydrometallurgy 69 (2003) 1-21.
Guerra, et al., A study of the factors affecting copper cementation of gold from ammoniacal thiosulphate solution, Hydrometallurgy 51 1999 155-172.
Ha, et al., Thiosulfate leaching of gold from waste mobile phones, Journal of Hazardous Materials 178 (2010) 1115-1119.
Ha, et al., Optimizing the thiosulphate leaching of gold from printed circuit boards of discarded mobile phone, Hydrometallurgy, 2014, pp. 1-44.
Hiskey, et al., Dissolution Chemistry of Gold and Silver in Different Lixiviants, Mineral Processingand Extractive Metallurgy Review, 1988, vol. 4. pp. 95-134.
Hiskey, et al., Kinetics of gold cementation on copper in ammoniacal thiosulfate solutions, Hydrometallurgy 69 (2003) 45-56.
Jeffrey, et al., The importance of controlling oxygen addition during the thiosulfate leaching of gold ores, Int. J. Miner. Process. 72 (2003) 323- 330.
Jeffrey, et al., Identification of surface species that inhibit and passivate thiosulfate leaching of gold, Minerals Engineering 21 (2008) 443-452.
Jeon, et al., The Effects of Coexisting Copper, Iron, Cobalt, Nickel, and Zinc Ions on Gold Recovery by Enhanced Cementation via Galvanic Interactions between Zero-Valent Aluminum and Activated Carbon in Ammonium Thiosulfate Systems, Metals 2021, 11, 1352, pp. 1-14.
Kasper, et al., Gold Recovery From Printed Circuit Boards of Mobile Phones Scraps Using a Leaching Solution Alternative to Cyanide, Brazilian Journal of Chemical Engineering, vol. 35, No. 03, pp. 931-942, Jul.-Sep. 2018.
Kasper, et al., Electrochemical study of gold recovery from ammoniacal thiosulfate, simulating the PCBs leaching of mobile phones, Electrochimica Acta 259 (2018) 500-509.
Konishi, et al., Behavior of Copper Dissolution in an Ammonia Solution Containing Ammonium Chloride or Sulfate, Jornal of JSEM, vol. 14, 2014, pp. s205-s209.
Koyama, et al., Electrolytic Copper Deposition from Ammoniacal Alkaline Solution Containing Cu(I), Materials Transactions, vol. 47, No. 8 (2006) pp. 2076 to 2080.
Koyama, et al., Copper Leaching Behavior from Waste Printed Circuit Board in Ammoniacal Alkaline Solution, Materials Transactions, vol. 47, No. 7 (2006) pp. 1788 to 1792.
Lee, et al., Electrochemical Study of Gold Cementation in Thiosulfate Solutions With an Electrochemical Quartz Crystal Nanobalance, Hydrometallurgy 2008, pp. 811-816.
Li, et al., Reaction kinetics for gold dissolution in acid thiourea solution using formamidine disulfide as oxidant, Hydrometallurgy 63 (2002) 215- 223.
Li, et al., Hydrometallurgical recovery of metals from waste printed circuit boards (WPCBs): Current status and perspectives—A review, Resources, Conservation & Recycling 139 (2018) 122-139.
Lister, et al., Recovery of critical and value metals from mobile electronics enabled by electrochemical processing, Hydrometallurgy 149 (2014) 228-237.
Lu, et al., Integrated technology for recovering Au from waste memory module by chlorination process: Selective leaching, extraction, and distillation, Journal of Cleaner Production 161 (2017) 30-39.
Meng, et al., The Principles and Applications of Ammonia Leaching of Metals—A Review, Mineral Processing and Extractive Metallurgy Review, 1996, vol. 16, pp. 23-61.
Molleman, et al., The treatment of copper-gold ores by ammonium thiosulfate leaching, Hydrometallurgy 66 (2002) 1-21.
Muir, et al., Thiosulphate as an alternative to cyanide for gold processing—issues and impediments , Mineral Processing and Extractive Metallurgy (Trans. Inst. Min. Metall. C) Mar. 2004 vol. 113.
Murali, et al., E-wastes derived sustainable Cu recovery using solvent extraction and electrowinning followed by hiosulfate-based gold and silver extraction, Journal of Hazardous Materials Advances 8 (2022) 100196.
Nie, et al., Connection between gold dissolution in thiosulfate leaching and Cu(II) complexes during the cathodic process, Electrochimica Acta 328 (2019) 135079.
Oishi, et al., Recovery of high purity copper cathode from printed circuit boards using ammoniacal sulfate or chloride solutions, Hydrometallurgy, 89, 2007, pp. 82-88.
Oishi, et al., Influence of ammonium salt on electrowinning of copper from ammoniacal alkaline solutions, Electrochimica Acta 53 (2007) 127-132.
Oishi, et al., Hydrometallurgical process for the recycling of copper using anodic oxidation of cuprous ammine complexes and flow-through electrolysis, Electrochimica Acta 53 (2008) 2585-2592.
Oishi, et al., Effect of phosphate on lead removal during a copper recycling process from wastes using ammoniacal chloride solution, Hydrometallurgy 90 (2008) 161-167.

(56) References Cited

OTHER PUBLICATIONS

Oraby, et al., Effect of Silver in Thiosulfate Leaching of Gold—Silver Alloys in the Presence of Copper and Ammonia Relative to Pure Gold and Silver, Mineral Processing & Extractive Metall. Rev., 35: 136-147, 2014.
Park, et al., Recovery of high purity precious metals from printed circuit boards, Journal of Hazardous Materials 164 (2009) 1152-1158.
Peri, et al., Dissolution behavior of gold in ammoniacal solutions with iodine as an oxidant, Minerals & Metallurgical Processing, vol. 18, No. 1, 2001, pp. 13-17.
Petter, et al., Evaluation of gold and silver leaching from printed circuit board of cellphones, Waste Management 34 (2014) 475-482.
Rudnik, et al., Study on copper recovery from smelted low-grade e-scrap using hydrometallurgical methods, Minerals & Metallurgical Processing, vol. 34, No. 1, 2007, pp. 20-30.
Rudnik, et al., Ammoniacal leaching and recovery of copper from alloyed low-grade e-waste, J Mater Cycles Waste Manag (2016) 18:318-328.
Senanayake, et al., Analysis of reaction kinetics, speciation and mechanism of gold leaching and thiosulfate oxidation by ammoniacal copper(II) solutions, Hydrometallurgy 75 (2004) 55-75.
Senanayake, et al., Gold leaching in non-cyanide lixiviant systems: critical issues on fundamentals and applications, Minerals Engineering 17 (2004) 785-801.
Senanayake, et al., Gold leaching by thiosulphate solutions: a critical review on copper(II)-thiosulphate-oxygen interactions, Minerals Engineering 18 (2005) 995-1009.
Senanayake, et al., Review of rate constants for thiosulphate leaching of gold from ores, concentrates and flat surfaces: Effect of host minerals and pH, Minerals Engineering 20 (2007) 1-15.
Senanayake, et al., The role of ligands and oxidants in thiosulfate leaching of gold, Gold Bulletin 2005, pp. 170-179.
Shi, et al., Kinetic characteristics and mechanism of copper leaching from waste printed circuit boards by environmental friendly leaching system, Process Safety and Environmental Protection 166 (2022) 123-132.
Sun, et al., Selective copper recovery from complex mixtures of end-of-life electronic products with ammonia-based solution, Hydrometallurgy 152 (2015) 91-99.
Sun, et al., A Cleaner Process for Selective Recovery of Valuable Metals from Electronic Waste of Complex Mixtures of End-of-Life Electronic Products, Environ. Sci. Technol. 2015, 49, 7981-7988.
Sun, et al., Complex electronic waste treatment—An effective process to selectively recover copper with solutions containing different ammonium salts, Waste Management 57 (2016) 140-148.
Sun, et al., Electrochemistry during efficient copper recovery from complex electronic waste using ammonia based solutions, Front. Chem. Sci. Eng. 2017, 11(3): 308-316.
Tripathi, et al., Leaching of Gold from the Waste Mobile Phone Printed Circuit Boards (PCBs) with Ammonium Thiosulphate, International Journal of Metallurgical Engineering 2012, 1(2): 17-21.
Velasquez-Yevenes, et al., The aqueous chemistry of the copper-ammonia system and its implications for the sustainable recovery of copper, Cleaner Engineering and Technology 9 (2022).
Xiao, et al., Hydrometallurgical recovery of copper from complex mixtures of end-of-life shredded ICT products, Hydrometallurgy 140 (2013) 128-134.
Wan, et al., Solution chemistry factors for gold thiosulfate heap leaching, Int. J. Miner. Process. 72 (2003) 311-322.
Xiu, et al., Leaching of Au, Ag, and Pd from waste printed circuit boards of mobile phone by iodide lixiviant after supercritical water pre-treatment, Waste Management 41 (2015) 134-141.
Xu, et al., Current status and future perspective of recycling copper by hydrometallurgy from waste printed circuit boards, Procedia Environmental Sciences 31 ( 2016 ) 162-170.
Xu, et al., A Review of Thiosulfate Leaching of Gold: Focus on Thiosulfate Consumption and Gold Recovery from Pregnant Solution, Metals 2017, 7, 222.
Yoo, et al., Development of Ammoniacal Leaching Processes; A Review, J. of Korean Inst. of Resources Recycling vol. 21, No. 5, 2012, 3-17.
Zhang, et al., A study of the gold colloid dissolution kinetics in oxygenated ammoniacal thiosulfate solutions, Hydrometallurgy 74 (2004) 243-257.
Senanayake, et al., Catalytic role of ammonia in the anodic oxidation of gold in copper-free thiosulfate solutions, Hydrometallurgy 77 (2005) 287-293.

* cited by examiner

EXTRACTION OF COPPER, GOLD AND OTHER ELEMENTS FROM WASTE MATERIALS

RELATED APPLICATION

This application is a § 371 National State Application of PCT/US2021/017109 filed Feb. 8, 2021 which claims priority to U.S. Provisional Patent Application Ser. No. 62/972,379 filed on Feb. 10, 2020 and U.S. Provisional Patent Application Ser. No. 62/971,472 filed on Feb. 7, 2020, both of which are hereby incorporated by reference in their entirety.

TECHNICAL FIELD

This document relates generally to the extraction of copper, gold and other elements of value from waste materials including, particularly E-waste materials.

BACKGROUND

For purposes of this document "waste materials" broadly refers to any waste materials potentially including valuable elements and, more particularly, metals that may be reclaimed and recycled. Thus, waste materials include E-waste materials, auto shred materials containing base and precious metals, communications equipment such as plated wave guides, mixed metal conductors or wires, and the like. For purposes of this document, E-waste materials means any such material comprised of at least copper and one precious metal.

This document describes a new and improved method for the enhanced recovery of copper, gold and other valuable metals and materials from waste materials in a more efficient and cost effective manner.

SUMMARY

In accordance with the purposes and benefits set forth herein, a new and improved method is provided for recovering metals from waste materials. That method broadly comprises the steps of: (a) contacting a waste material feed stream with a first ammonia-based lixiviant adapted to leach copper and other base metals from the waste material feed stream and provide a treated waste material feed stream, (b) recovering copper metal from the first ammonia-based lixiviant, (c) contacting the treated waste material feed stream with a second lixiviant adapted to leach noble metals from the treated waste material feed stream and (d) recovering at least one noble metal from the second lixiviant.

The method may also include the step of shredding the waste material feed stream before the contacting of the waste material feed stream with the first ammonia-based lixiviant.

The method may also include the step of extracting the other base metals from the first ammonia-based lixiviant before the recovering of the copper metal from the first ammonia-based lixiviant.

In one or more of the many possible embodiments of the method, the method includes the step of using electrowinning in the recovering of the copper metal from the first ammonia-based lixiviant. Further, the method may include the step of generating $Cu^{2+}$ during electrowinning and using the generated $Cu^{2+}$ as an oxidant for (a) leaching the copper and the other base metals from the waste material feed stream and (b) leaching the noble metals from the treated waste material feed stream.

In one or more of the many possible embodiments of the method, the method includes the step of treating the material feed waste stream with the first ammonia-based lixiviant in a first leaching circuit. In one or more of the many possible embodiments of the method, the method also includes the step of transferring the treated waste material feed stream to a second leaching circuit where the treated waste material feed stream is contacted with the second lixiviant. Further, the method may include using thiosulfate leaching to leach the noble metals from the treated E-waste stream in the second leaching circuit.

Still further, the method may include using a precipitation reaction, such as a Merrell Crowe reaction, for the recovery of gold from the second lixiviant.

In accordance with an additional aspect, the new and improved method includes the steps of: (a) shredding the waste materials, (b) metering a shredded waste material feed stream into a first leaching circuit, (c) leaching copper and other base metals from the shredded waste material feed stream to produce a treated waste material feed stream and (d) leaching at least one noble metal from the treated waste material feed stream in a second leaching circuit.

This method may also include the step of using ammonia leaching in the first leaching circuit to leach the copper and the other base metals from the shredded waste material feed stream. The method may also include the step of using thiosulfate leaching in the second leaching circuit to leach the at least one noble metal from the treated waste material feed stream.

In one or more of the many possible embodiments of the method, the method includes the step of using solvent extraction to remove the other base metals from the first lixiviant used in the first leaching circuit. This may then be followed by the step of recovering the copper from the first lixiviant by means of electrowinning.

In one or more of the many possible embodiments of the method, the method may include the step of generating $Cu^{2+}$ ions during the electrowinning and using the $Cu^{2+}$ ions as an oxidant for (a) leaching the copper and the other base metals in the first leaching circuit and (b) leaching the at least one noble metal in the second leaching circuit.

The method may include the step of maintaining a $Cu^{2+}$ ion concentration in a first lixiviant of the first leaching circuit of between about 0.0001 M and about 1.6 M. The method may include the step of maintaining a $Cu^{2+}$ ion concentration in a second lixiviant of the second leaching circuit of between about 0.0001 M and about 0.1 M.

In one or more of the many possible embodiments of the method, the method includes the step of using solvent extraction to remove other contaminant metals from the first lixiviant used in the first leaching circuit prior to the recovering of the copper from the first lixiviant.

In one or more of the many possible embodiments of the method, the method includes the step of using precipitation reaction for recovering gold from the second lixiviant.

In one or more of the many possible embodiments of the method, the method includes: (a) moving the shredded waste material feed stream in a first direction through a first plurality of reactor vessels forming the first leaching circuit, (b) moving the first lixiviant in a second, opposite direction through the first plurality of reactor vessels forming the first leaching circuit thereby providing a countercurrent flow in the first leaching circuit, (c) moving the treated waste feed stream in a third direction through a second plurality of reactor vessels forming the second leaching circuit and (d) moving the second lixiviant in a fourth, opposite direction through the second plurality of reactor vessels forming the second leaching circuit thereby providing a counter current flow in the second leaching circuit.

In the following description, there are shown and described several preferred embodiments of the method. As it should be realized, the method is capable of other, different embodiments and its several details are capable of modification in various, obvious aspects all without departing from the method as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the patent specification, illustrate several aspects of the method and one possible apparatus for performing the method and together with the description serve to explain certain principles thereof.

Reference will now be made in detail to the present preferred embodiments of the method, examples of which are illustrated in the accompanying drawing figures.

DETAILED DESCRIPTION

Theory of Ammonium Leaching for Base Metal (Cu)

Chemical reactions—In ammonia leaching, ammonium salts ($NH_4Cl$ or $(NH_4)_2SO_4$), and possible combinations of copper compounds such as $CuSO_4$, CuO, $Cu_2O$) combined with ammonia ($NH_3$ in forms of $NH_4OH$) are dissolved in water and used as the lixiviant. The dominant species in a Metal-$NH_3$—$H_2O$ system are $NH_3$, $NH_4^+$, $H^+$, $OH^-$ and corresponding anions. The corresponding metal species are complexed with the existing $NH_3$ and $OH^-$ ions and corresponding anions. In an embodiment, the leaching of Cu by ammonia/ammonium solution can be divided into two steps: 1) the oxidation of $Cu^0$ to $Cu^{2+}$ by oxidant such as $O_2$, O2 via air, $H_2O_2$, or $Fe^{3+}$, and the formation of CuO; 2) the dissolution of CuO in ammonia/ammonium solution and the generation of soluble copper-ammonia complex.

$$2Cu+O_2\rightarrow 2CuO \quad \text{Equation 1}$$

$$CuO+2NH_3\cdot H_2O+2NH_4^+\rightarrow Cu(NH_3)_4^{2+}+3H_2O \quad \text{Equation 2}$$

In the preferred embodiment, leaching of copper, and by extension other base metals. The major reactions are described as follows:

$$Cu(NH_3)_4^{2+}+e^-=Cu(NH_3)_2^+ +2NH_3 \quad \text{Equation 3}$$

$$Cu(NH_3)_2^+ +e^-=Cu+e^-=Cu+2NH_3 \quad \text{Equation 4}$$

Figure 1:
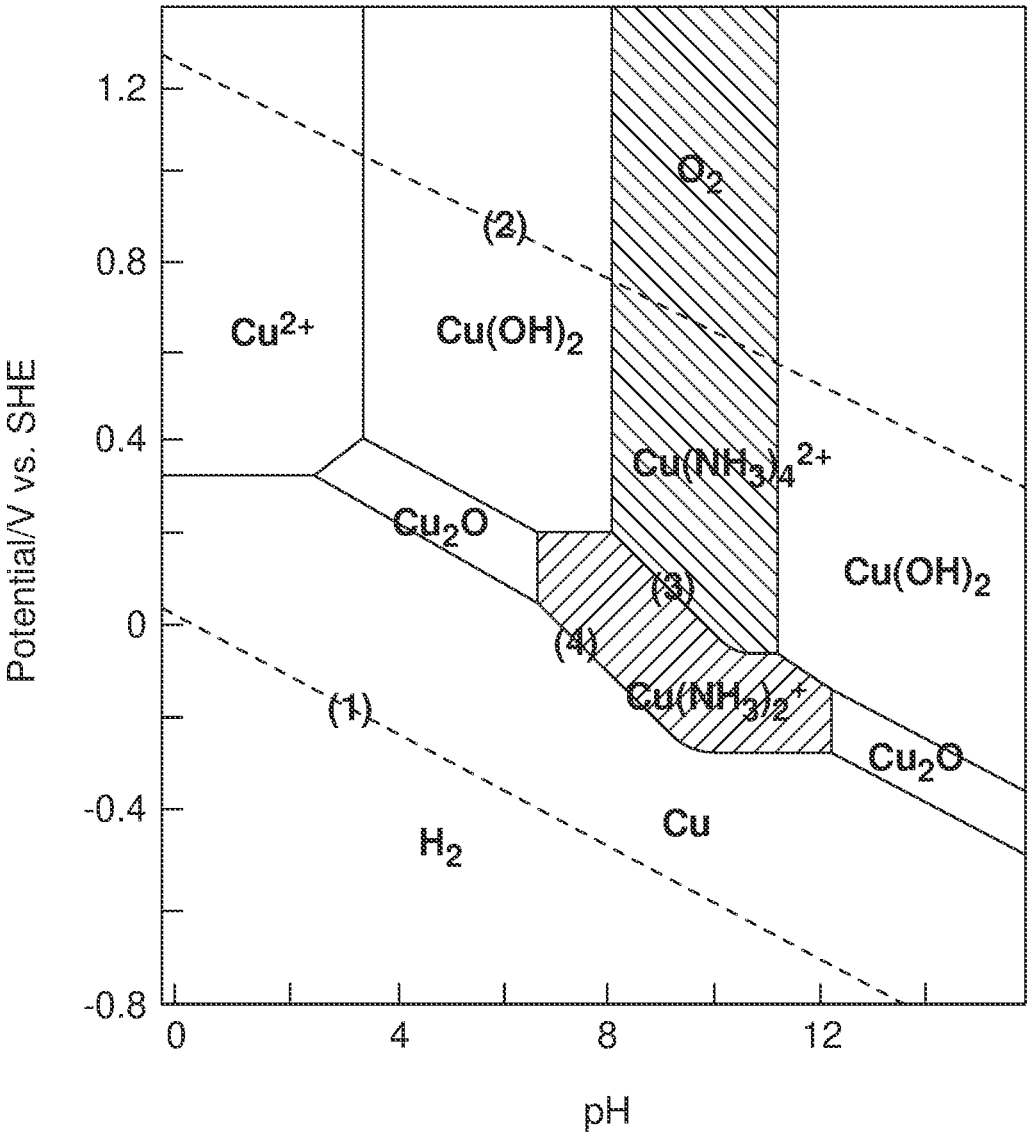
FIG. 1 is an Eh-pH diagram for a Cu—$NH_3$—$H_2O$ system at 298° K.

Eh-pH diagrams—The Eh-pH diagrams (Pourbaix diagrams) of Cu—$NH_3$—$H_2O$ system are referenced from the existing literature in order to better illustrate the copper speciation in ammonia/ammonium matrix as shown in FIG. 1. According to this diagram, complexes of $Cu^+$ and $Cu^{2+}$ with $NH_3$ are stable ionic species in neutral and alkaline solutions. In the presence of $NH_3$, $Cu^+$ and $Cu^{2+}$ mainly exists as $Cu(NH_3)_2^+$ and $Cu(NH_3)_4^{2+}$ in the water stability zone (between two dash lines referenced as (1) for hydrogen evolution and (2) for oxygen evolution). This result indicates that Cu can be theoretically leached out in ammonia/ammonium solution (equation 4 indicated by (4) in FIG. 1) and stably remain in solution as complexes with $NH_3$. Additionally, the more positive oxidation-reduction potential (ORP) of $Cu(NH_3)_4^{2+}/Cu$ than $Cu(NH_3)_2^+/Cu$ indicates that $Cu(NH_3)_4^{2+}$ can serve as an oxidant to oxidize $Cu^0$ to $Cu^+/Cu^{2+}$ in ammonia/ammonium alkaline solution (equation 3 indicated by (3) in FIG. 1).

Theory of Electrowinning in Ammonium Alkaline Solutions

Figure 2:
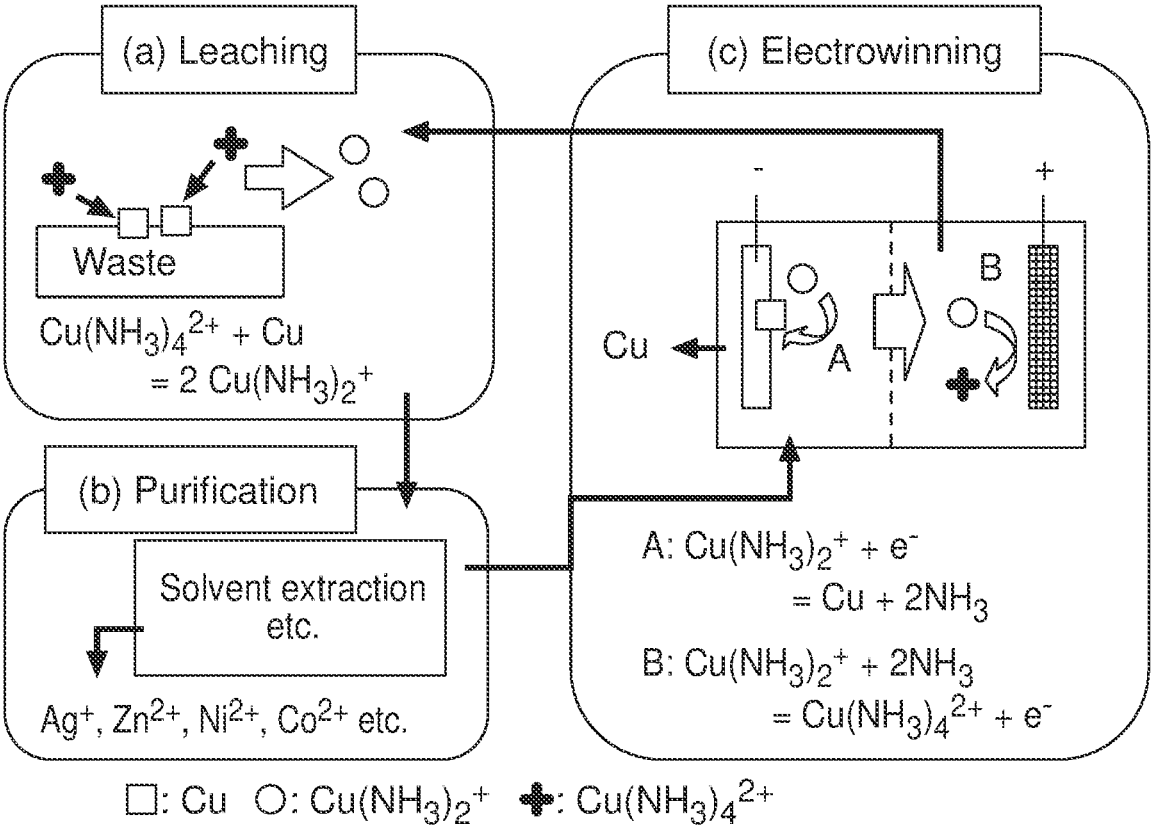
FIG. 2 is schematic diagram of a copper recovery process using ammoniacal alkaline solutions.

Chemical reactions—After the leaching stage, where copper is leached out as divalent ions in ammonia/ammonium solution, contaminant ions in the solution may be extracted via solvent extraction. The purified electrolyte is conveyed to the electrowinning stage. Such a copper recovery process is schematically illustrated in FIG. 2. The cathodic and anodic reaction in copper electrowinning are described by the following equations:

$$Cu(NH_3)_2^+ +e^-=Cu+2NH_3, \text{ See FIG. 1, (4) for corresponding interface} \quad \text{Equation 5}$$

$$Cu(NH_3)_4^{2+}+e^-=Cu(NH_3)_2^+ +2NH_3, \text{ See FIG. 1, (3) for corresponding interface} \quad \text{Equation 6}$$

Reaction mechanism—In an embodiment of the leaching process, electronic wastes are leached in the ammonium solution containing $Cu(NH_3)_4^{2+}$ ions ($Cu^{2+}$), and the metallic copper) ($Cu^0$) in the wastes reacts with the $Cu^{2+}$ and is dissolved as $Cu(NH_3)_2^+$ ions ($Cu^+$) through the oxidation process described in equations 5 and 6. In the following solvent extraction process, the other base metals or undesired impurities such as iron, aluminum, nickel, cobalt and zinc (tri and divalent ions), can be separated using a selective extractant in ways known in the art. In this embodiment, the electrowinning stage, high purity $Cu^0$ is obtained on the cathode from the $Cu^+/Cu^{2+}$ containing solution. Simultaneously, $Cu^+$ is oxidized to $Cu^{2+}$ on the anode and the produced $Cu^{2+}$ is recycled back in the leaching stage as the oxidizing reagent.

Ammonium Thiosulfate Leaching for the Noble Metal (Au)

Chemical reactions—In thiosulfate leaching for gold, the formation of gold thiosulfate complex proceeds via the catalytic oxidation reaction with $Cu(NH_3)_4^{2+}$ acting as the primary oxidant. This process can be divided into two steps: 1) the oxidation of $Au^0$ to $Au^+$ in forms of $Au(NH_3)_2^+$ under the oxidative environment provided by the presence of $Cu(NH_3)_4^{2+}$, which is also a product from the previous copper ammonia leaching process; 2) the $Au(NH_3)_2^+$ complex further reacts with $S_2O_3^{2-}$ ion in the solution and forms stable $Au(S_2O_3)_2^{3-}$ specie. The reactions are as follows:

$$Au^0+Cu(NH_3)_4^{2+}+3S_2O_3^{2-}\rightarrow Au(NH_3)_2^+ + Cu(S_2O_3)_3^{5-}+2NH_3 \quad \text{Equation 7}$$

$$Au(NH_3)_2^+ +2S_2O_3^{2-}\rightarrow Au(S_2O_3)_2^{3-}+2NH_3 \quad \text{Equation 8}$$

Figure 3:
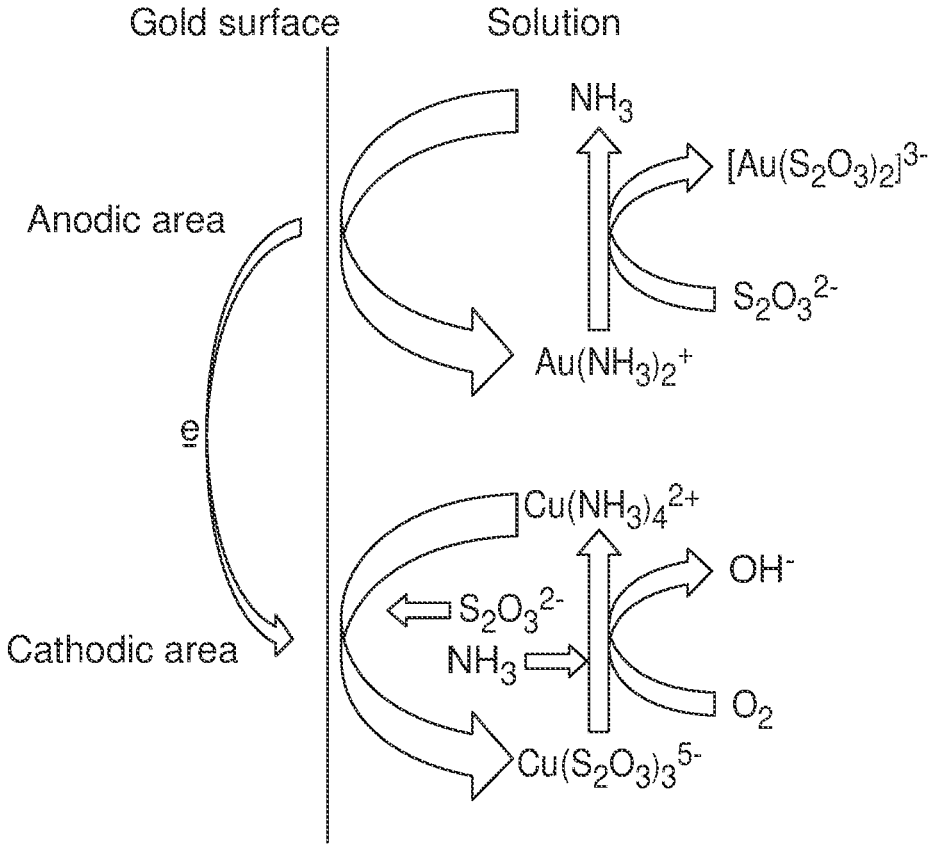
FIG. 3 is a schematic illustration of the electrochemical-catalytic mechanism of thiosulfate leaching.

A schematic of the mechanism of gold thiosulfate leaching is shown in FIG. 3.

Figure 4:
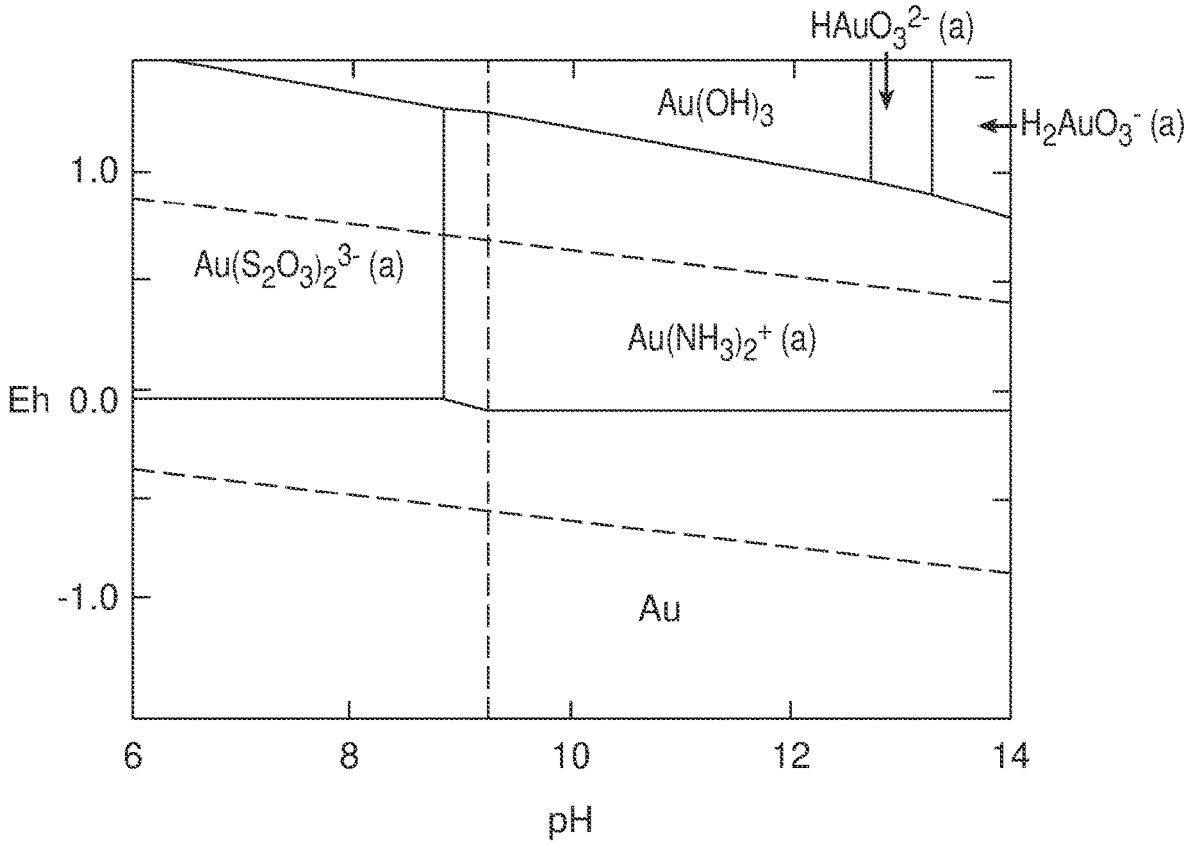
FIG. 4 is an Eh-pH diagram of the gold-thiosulfate-ammonia-water system at 25° C. wherein the activities of the species are $2.5\times10^{-5}$ M Au (5 ppm), 0.2 M $S_2O_3^{2-}$ and 0.4 M $NH_3/NH_4^+$ [$\Delta G_f^0(S_2O_3^{2-})=-518.8$ kJ/mol].

FIG. 4 shows that the gold-ammonia complex appears next to the stability region of gold-thiosulfate complex. The gold-thiosulfate complex ($Au(S_2O_3)^{3-}$) is more stable below pH 9 whereas the gold-ammonia complex ($Au(NH_3)_2^+$) is dominant at pH greater than 9. With the manipulation of pH, it is possible to leach gold using thiosulfate solution in the presence of copper-ammonia complex as catalyst, based on Equation 7 and Equation 8.

Figure 5:
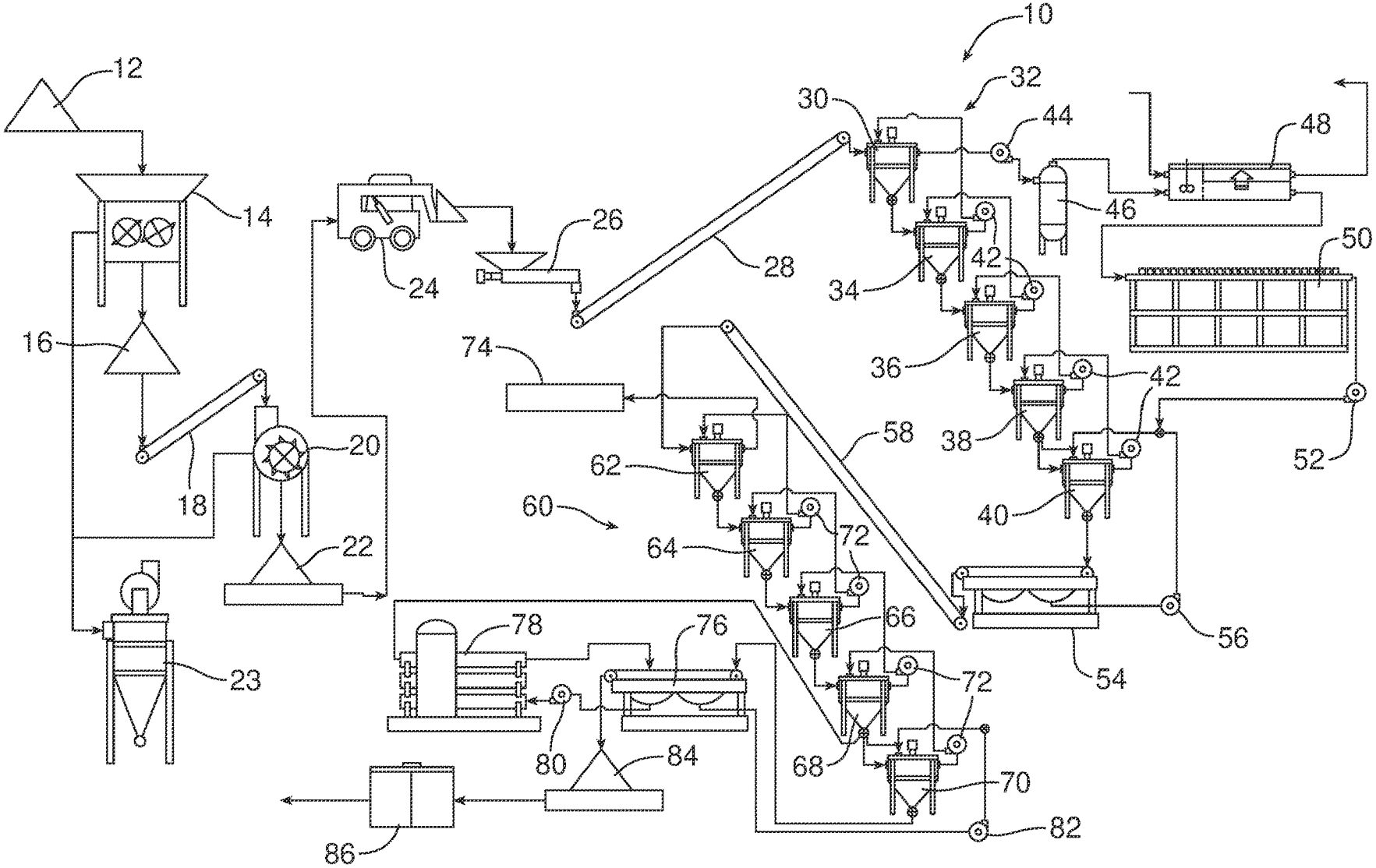
FIG. 5 is a schematic diagram of one possible apparatus for performing the method.

Reference is now made to FIG. 5 which schematically illustrates an apparatus 10 for conducting the new and improved method for recovering valuable metals, such as copper and gold, from waste materials and particularly E-waste materials.

As illustrated, waste materials 12, may be fed into a coarse shredder 14 of a type known in the art to be useful for the coarse shredding of such materials. The coarse shredded waste materials 16 are then fed by a conveyor 18 or other means to a fine shredder 20 of a type known in the art for the fine shredding of such materials. In one possible embodiment, the E-waste materials are shredded to a size of between about 0.010 mm and about 10 mm. Any dust that might be generated during the shredding process may be collected at the cyclone 23 which may be leached or separated.

Next, the fine shredded waste materials 22 are transferred by a skid steer 24 or other means to a metered feeder 26 of a type known in the art to be useful for the metered feeding of such materials. The metered E-waste material may then be transferred by a conveyor 28 or other useful means to the first reactor vessel or unit 30 of a first leaching circuit, generally designated as 32.

In the illustrated embodiment, the first leaching circuit 32 includes a total of five reactor vessels designated 30, 34, 36, 38 and 40 that are connected in series and form a counter current leaching arrangement. The waste material feed stream delivered to the first unit 30 is contacted with a first lixiviant in the units 30, 34, 36, 38 and 40 of the first leaching circuit 32. That first lixiviant is particularly adapted to leach copper metal and other base metals from the waste material feed stream while leaving any noble metals behind in the treated waste material feed stream that is ultimately discharged from the first leaching circuit 32.

In one particularly useful embodiment, the E-waste material feed stream is subjected to ammonia leaching in the first leaching circuit 32 in order to leach the copper and the other base metals from the waste material feed stream. As noted above, ammonia leaching uses ammonium salts ($NH_4Cl$ or $(NH_4)_2SO_4$) combined with ammonia ($NH_3$ in form of $NH_4OH$) dissolved in deionized water.

As should be appreciated, the waste material feed stream travels in a first direction through the first leaching circuit 32 from the first reactor vessel 30, to the second reactor vessel 34, then to the third reactor vessel 36, then to the fourth reactor vessel 38 and then finally to the fifth reactor vessel 40. The first ammonia-based lixiviant travels in a second opposite direction in a countercurrent flow to the waste material feed stream from the fifth reactor vessel 40, to the fourth reactor vessel 38, then to the third reactor vessel 36, then to the second reactor vessel 34 and then finally to the first reactor vessel 30. The various pumps 42 move the first ammonia-based lixiviant through the reactor vessels 40, 38, 36, 34 and 30 of the first leaching circuit 32. The first ammonia-based lixiviant is first transferred from the first reactor vessel 30 by the pump 44 to a filter 46 which captures any remaining particles of the waste material feed stream. The filtered first lixiviant is then transferred to a solvent extraction circuit 48 of a type known in the art, that is adapted to remove base metals other than copper from the first lixiviant. Those other base metals include, but are not necessarily limited to, iron, nickel, chromium, silver, zinc, cobalt and the like.

The treated first ammonia-based lixiviant with the copper ions retained and the other base metal ions extracted is then transferred to an electrowinning press 50 of the type disclosed in, for example, copending PCT International application serial number PCT/US2021/017104 (the full disclosure of which is incorporated herein by reference) filed concurrently herewith and entitled Electrowinning Cells for The Segregation of the Cathodic and Anodic Compartments. There, copper metal is recovered from the first ammonia-based lixiviant on the cathodes of the electrowinning cells making up the electrowinning press.

During the electrowinning process, $Cu^{2+}$ ions are generated in the first lixiviant. These $Cu^{2+}$ ions are used as an oxidant in the leaching of the copper and the other base metals from the waste material feed stream in the first leaching circuit. The first lixiviant, minus the now recovered copper metal and plus the $Cu^{2+}$ ions generated during electrowinning is returned to the reactor vessel 40 of the first leaching circuit 32 by the pump 52. Preferably, the $Cu^{2+}$ ion concentration in the first lixiviant of the first leaching circuit 32 is maintained between about 0.0001 M and about 1.6 M to enhance the leaching efficiency of the first circuit. The $Cu^{2+}$ ion concentration may be adjusted by controlling the rate of the metered feeding of waste material to the first circuit, the lixiviant flow rate, between stage solid transfer rate or the current in the electrowinning cell 32.

The treated waste material feed stream is delivered from the last reactor vessel 40 of the first leaching circuit 32 to a belt filter wash (or other solid/liquid separators and conveyances of a type known in the art) 54 where the majority of the first lixiviant remaining on the treated E-waste stream is recovered and returned by the pump 56 to the unit 40 of the first leaching circuit 32.

The treated E-waste feed stream with some remaining first lixiviant, including $Cu^{2+}$ ions, is then transferred by the conveyor 58 to the second leaching circuit generally designated by reference numeral 60 where it is contacted with a second lixiviant. The $Cu^{2+}$ ion concentration in the second lixiviant is preferably maintained between about 0.0001 M and about 0.1 M in the second lixiviant in order to provide sufficient oxidization to efficiently leach the at least one noble metal from the treated waste material stream. If desired, additional oxidizer for leaching may be provided by sparging oxygen through the second lixiviant.

In the illustrated embodiment, the second leaching circuit includes five reactor vessels or units 62, 64, 66, 68 and 70 connected in series. The treated E-waste material feed stream delivered to the second leaching circuit 60 is contacted with a second lixiviant in the units 62, 64, 66, 68 and 70. The second lixiviant is particularly adapted to recover at least one noble metal from the treated E-waste feed stream. For purposes of this document, "noble metals" include silver, platinum, palladium and gold.

In one particularly useful embodiment of the method, the method uses thiosulfate leaching to leach the noble metals from the treated waste material feed stream in the second leaching circuit 60. As noted above, the $Cu^{2+}$ ions in any remaining first lixiviant on the treated waste material feed stream transferred to the second leaching circuit 60 acts as a primary oxidizer to catalyze the leaching of the at least one noble metal, and, more particularly, the gold from the treated E-waste feed stream.

As should be appreciated, the treated waste material feed stream travels in a third direction through the second leaching circuit 60 from the first reactor vessel 62, to the second reactor vessel 64, then to the third reactor vessel 66, then to the fourth reactor vessel 68 and then finally to the fifth reactor vessel 70. The second lixiviant travels in a fourth direction in a countercurrent flow to the treated waste material feed stream from the fifth reactor vessel 70, to the fourth reactor vessel 68, then to the third reactor vessel 66, then to the second reactor vessel 64 and then finally to the first reactor vessel 62. The various pumps 72 move the second lixiviant through the reactor vessels 70, 68, 66, 64 and 62 of the second leaching circuit 60. The second lixiviant is then transferred from the first reactor vessel 62 by a pump or other appropriate device (not shown) to a Merrill Crowe plant 74 wherein a precipitation reaction of a type known in the art is used to recover the noble metal, and, more particularly, the gold from the second lixiviant.

In an embodiment the treated waste material feed stream exiting the second leaching circuit 60 at the fifth reactor vessel 70 is delivered to a belt filter and washing station 76 and a reverse osmosis unit 78 where all the reagents including the second lixiviant are washed from the treated waste material feed stream, recovered and then returned to the fifth reactor vessel 70 by the pumps 80 and 82. The now washed and treated waste material feed stream 84 may then be dried in an oven 86 with the tails deposed of in a suitable and ecologically sound manner or readied for further processing.

This disclosure may be considered to relate to the following items:

1. A method of recovering metals from waste materials, comprising:
   contacting a waste material feed stream with a first ammonia-based lixiviant adapted to leach copper and other base metals but not noble metals from the waste material feed stream and provide a treated waste material feed stream;
   recovering copper metal from the first ammonia-based lixiviant:
   contacting the treated waste material feed stream with a second lixiviant adapted to leach noble metals from the treated waste material feed stream; and
   recovering at least one noble metal from the second lixiviant.
2. The method of item 1, including extracting the other base metals from the first ammonia-based lixiviant before the recovering of the copper metal from the first ammonia-based lixiviant.
3. The method of item 2, including using electrowinning in the recovering of the copper metal from the first ammonia-based lixiviant.
4. The method of item 3, including shredding the waste feed stream before the contacting of the waste material feed stream with the first ammonia-based lixiviant.
5. The method of item 4, including treating the waste material feed stream with the first ammonia-based lixiviant in a first leaching circuit.
6. The method of item 5, including transferring the treated waste material feed stream to a second leaching circuit where the treated waste material feed stream is contacted with the second lixiviant.
7. The method of item 6, including using metal ions in any first ammonia-based lixiviant remaining with the treated waste material feed stream as an oxidant for the second lixiviant and the leaching of the noble metals.
8. The method of item 7, including using a cementation or precipitation reaction for the recovery of gold from the second lixiviant.
9. The method of item 8, including generating Cu2+ ions during electrowinning and using said Cu2+ ions as an oxidant for (a) leaching the copper and the other base metals from the waste material feed stream and (b) as an oxidant for leaching the noble metals from the treated waste material feed stream.
10. The method of item 9, including using thiosulfate leaching to leach the noble metals from the treated waste material feed stream.
11. The method of item 10, including recovering the other base metals after the extracting of the other base metals.
12. The method of item 1, including using electrowinning in the recovering of the copper metal from the first ammonia-based lixiviant.
13. The method of item 12 including generating Cu2+ ions during electrowinning and using said Cu2+ ions as an oxidant for (a) leaching the copper and the other base metals from the waste material feed stream and (b) as an oxidant for leaching the noble metals from the treated waste material feed stream.
14. The method of item 1, including shredding the waste feed stream before the contacting of the waste material feed stream with the first ammonia-based lixiviant.
15. The method of item 1, including treating the waste material feed stream with the first ammonia-based lixiviant in a first leaching circuit.
16. The method of item 15, including transferring the treated waste material feed stream to a second leaching circuit where the treated waste material feed stream is contacted with the second lixiviant.
17. The method of item 1, including using metal ions in any first ammonia-based lixiviant remaining with the treated waste material feed stream as an oxidant for the second lixiviant and the leaching of the noble metals.
18. The method of item 1, including using a cementation or precipitation reaction for the recovery of gold from the second lixiviant.
19. The method of item 1, including using thiosulfate leaching to leach the noble metals from the treated waste material feed stream.
20. A method of recovering metals from waste materials, comprising:
    metering a waste material feed stream into a first leaching circuit;
    leaching copper and other base metals from the waste material feed stream in the first leaching circuit to produce a treated waste material feed stream;
    moving the treated waste material feed stream from the first leaching circuit to a second leaching circuit; and
    leaching at least one noble metal from the treated waste material feed stream in the second leaching circuit.
21. The method of item 20, including using ammonia leaching in the first leaching circuit to leach the copper and other base metals from the waste material feed stream.
22. The method of item 21, including using thiosulfate leaching in the second leaching circuit to leach the at least one noble metal from the treated waste material feed stream.
23. The method of item 22, including recovering the copper from the first lixiviant by electrowinning.
24. The method of item 23, including generating Cu2+ ions during electrowinning and using said Cu2+ ions as an oxidant for (a) leaching the copper and the other base metals in the first leaching circuit and (b) as an oxidant for leaching the at least one noble metal in the second leaching circuit.
25. The method of item 24, including maintaining a Cu2+ ion concentration in a first lixiviant of the first leaching circuit of between about 0.0001 M and about 1.6 M.

26. The method of item 25, including maintaining a Cu2+ ion concentration in a second lixiviant of the second leaching circuit of between about 0.0001 M and about 0.1 M.
27. The method of item 26, including using a cementation or precipitation reaction for recovering gold from the second lixiviant.
28. The method of item 27, including using solvent extraction to remove the other base metal from the first lixiviant used in the first leaching circuit.
29. The method of item 28 including: (a) moving the waste material feed stream in a first direction through a first plurality of reactor vessels forming the first leaching circuit, (b) moving the first lixiviant in a second, opposite direction through the first plurality of reactor vessels forming the first leaching circuit thereby providing a countercurrent flow in the first leaching circuit, (c) moving the treated waste feed stream in a third direction through a second plurality of reactor vessels forming the second leaching circuit and (d) moving the second lixiviant in a fourth, opposite direction through the second plurality of reactor vessels forming the second leaching circuit thereby providing a countercurrent flow in the second leaching circuit.
30. The method of item 20, including using thiosulfate leaching in the second leaching circuit to leach the at least one noble metal from the treated waste material feed stream.
31. The method of item 20, including recovering the copper from the first lixiviant by electrowinning.
32. The method of item 31, including generating Cu2+ ions during electrowinning and using said Cu2+ ions as an oxidant for (a) leaching the copper and the other base metals in the first leaching circuit and (b) as an oxidant for leaching the at least one noble metal in the second leaching circuit.
33. The method of item 32, including maintaining a Cu2+ ion concentration in a first lixiviant of the first leaching circuit of between about 0.0001 M and about 1.6 M.
34. The method of item 33, including maintaining a Cu2+ ion concentration in a second lixiviant of the second leaching circuit of between about 0.0001 M and about 0.1 M.
35. The method of item 20, including using a cementation or precipitation reaction for recovering gold from the second lixiviant.
36. The method of item 20, including using solvent extraction to remove the other base metal from the first lixiviant used in the first leaching circuit.
37. The method of item 20, including: (a) moving the waste material feed stream in a first direction through a first plurality of reactor vessels forming the first leaching circuit, (b) moving the first lixiviant in a second, opposite direction through the first plurality of reactor vessels forming the first leaching circuit thereby providing a countercurrent flow in the first leaching circuit, (c) moving the treated waste feed stream in a third direction through a second plurality of reactor vessels forming the second leaching circuit and (d) moving the second lixiviant in a fourth, opposite direction through the second plurality of reactor vessels forming the second leaching circuit thereby providing a countercurrent flow in the second leaching circuit.

Each of the following terms written in singular grammatical form: "a", "an", and the", as used herein, means "at least one", or "one or more". Use of the phrase One or more" herein does not alter this intended meaning of "a", "an", or "the". Accordingly, the terms "a", "an", and "the", as used herein, may also refer to, and encompass, a plurality of the stated entity or object, unless otherwise specifically defined or stated herein, or, unless the context clearly dictates otherwise. For example, the phrases: "a unit", "a device", "an assembly", "a mechanism", "a component, "an element", and "a step or procedure", as used herein, may also refer to, and encompass, a plurality of units, a plurality of devices, a plurality of assemblies, a plurality of mechanisms, a plurality of components, a plurality of elements, and, a plurality of steps or procedures, respectively.

Each of the following terms: "includes", "including", "has", "having", "comprises", and "comprising", and, their linguistic/grammatical variants, derivatives, or/and conjugates, as used herein, means "including, but not limited to", and is to be taken as specifying the stated component(s), feature(s), characteristic(s), parameter(s), integer(s), or step(s), and does not preclude addition of one or more additional component(s), feature(s), characteristic(s), parameter(s), integer(s), step(s), or groups thereof.

The term "method", as used herein, refers to steps, procedures, manners, means, or/and techniques, for accomplishing a given task including, but not limited to, those steps, procedures, manners, means, or/and techniques, either known to, or readily developed from known steps, procedures, manners, means, or/and techniques, by practitioners in the relevant field(s) of the disclosed invention.

Terms of approximation, such as the terms about, substantially, approximately, etc., as used herein, refers to ±10% of the stated numerical value. Use of the terms parallel or perpendicular are meant to mean approximately meeting this condition, unless otherwise specified.

It is to be fully understood that certain aspects, characteristics, and features, of the method of recovering metals from waste material, which are, for clarity, illustratively described and presented in the context or format of a plurality of separate embodiments, may also be illustratively described and presented in any suitable combination or sub-combination in the context or format of a single embodiment. Conversely, various aspects, characteristics, and features, of the method which are illustratively described and presented in combination or sub-combination in the context or format of a single embodiment may also be illustratively described and presented in the context or format of a plurality of separate embodiments.

Although the method has been illustratively described and presented by way of specific exemplary embodiments, and examples thereof, it is evident that many alternatives, modifications, or/and variations, thereof, will be apparent to those skilled in the art. Accordingly, it is intended that all such alternatives, modifications, or/and variations, fall within the spirit of, and are encompassed by, the broad scope of the appended claims.

The foregoing has been presented for purposes of illustration and description. It is not intended to be exhaustive or to limit the embodiments to the precise form disclosed. Obvious modifications and variations are possible in light of the above teachings. For example, the other base metals or contaminants may be recovered or extracted by means other than solvent extraction including, for example, ion exchange, or precipitation. Further, illustrated embodiments refer to shredding of the waste material prior to processing. Other alternative or additional methods of preparing the waste material for processing include but are not limited to sizing the waste material by means other than shredding, removing ferro-magnetic materials by pretreatment with a magnet, pretreatment by eddy-current or sensor sorting and the like. All such modifications and variations are within the scope of the appended claims when interpreted in accordance with the breadth to which they are fairly, legally and equitably entitled.

What is claimed:

1. A method of recovering metals from waste materials, comprising:

metering a waste material feed stream into a first leaching circuit;

leaching copper and other base metals from the waste material feed stream in the first leaching circuit to produce a treated waste material feed stream by using ammonia leaching;

moving the treated waste material feed stream from the first leaching circuit to a second leaching circuit; and leaching at least one noble metal from the treated waste material feed stream in the second leaching circuit by using thiosulfate leaching wherein the method further includes (a) moving the waste material feed stream in a first direction through a first plurality of reactor vessels forming the first leaching circuit, (b) moving the first lixiviant in a second, opposite direction through the first plurality of reactor vessels forming the first leaching circuit thereby providing a countercurrent flow in the first leaching circuit, (c) moving the treated waste feed stream in a third direction through a second plurality of reactor vessels forming the second leaching circuit and (d) moving the second lixiviant in a fourth, opposite direction through the second plurality of reactor vessels forming the second leaching circuit thereby providing a countercurrent flow in the second leaching circuit.

2. The method of claim 1, including recovering the copper from the first lixiviant by electrowinning.

3. The method of claim 2, including generating $Cu^{2+}$ ions during electrowinning and using said $Cu^{2+}$ ions as an oxidant for (a) leaching the copper and the other base metals in the first leaching circuit and (b) as an oxidant for leaching the at least one noble metal in the second leaching circuit.

4. The method of claim 3, including maintaining a Cu2+ ion concentration in a first lixiviant of the first leaching circuit of between about 0.0001 M and about 1.6 M.

5. The method of claim 4, including maintaining a Cu2+ ion concentration in a second lixiviant of the second leaching circuit of between about 0.0001 M and about 0.1 M.

6. The method of claim 5, including using solvent extraction to remove the other base metal from the first lixiviant used in the first leaching circuit and using a cementation or precipitation reaction for recovering gold from the second lixiviant.

7. The method of claim 1, including recovering the copper from the first lixiviant by electrowinning and generating $Cu^{2+}$ ions during electrowinning and using said $Cu^{2+}$ ions as an oxidant for (a) leaching the copper and the other base metals in the first leaching circuit and (b) as an oxidant for leaching the at least one noble metal in the second leaching circuit.

8. The method of claim 7, including maintaining a Cu2+ ion concentration in a first lixiviant of the first leaching circuit of between about 0.0001 M and about 1.6 M.

9. The method of claim 8, including maintaining a Cu2+ ion concentration in a second lixiviant of the second leaching circuit of between about 0.0001 M and about 0.1 M.

10. The method of claim 1, including using a cementation or precipitation reaction for recovering gold from the second lixiviant.

11. The method of claim 1, including using solvent extraction to remove the other base metal from the first lixiviant used in the first leaching circuit.

* * * * *